US009086195B2

(12) United States Patent
Opolka

(10) Patent No.: US 9,086,195 B2
(45) Date of Patent: Jul. 21, 2015

(54) FLASHLIGHT THAT CAN BE FOCUSED

(75) Inventor: Rainer Opolka, Solingen, DE (US)

(73) Assignee: ZWEIBRUEDER OPTOELECTRONICS GmbH&Co.KG, Solingen (DE)

( * ) Notice: Subject to any disclaimer, the term of this patent is extended or adjusted under 35 U.S.C. 154(b) by 0 days.

(21) Appl. No.: 13/883,704

(22) PCT Filed: May 10, 2012

(86) PCT No.: PCT/DE2012/000481

§ 371 (c)(1),
(2), (4) Date: May 29, 2013

(87) PCT Pub. No.: WO2012/159601

PCT Pub. Date: Nov. 29, 2012

(65) Prior Publication Data

US 2014/0168959 A1 Jun. 19, 2014

(30) Foreign Application Priority Data

May 25, 2011 (DE) ..... PCT/DE2011/001148
Dec. 15, 2011 (DE) ..... 20 2011 109 155 U

(51) Int. Cl.

| | |
|---|---|
| ***F21L 4/04*** | (2006.01) |
| ***F21L 4/00*** | (2006.01) |
| ***F21V 1/00*** | (2006.01) |
| ***F21V 17/02*** | (2006.01) |
| ***F21L 4/02*** | (2006.01) |
| ***F21V 14/06*** | (2006.01) |
| ***F21V 15/01*** | (2006.01) |
| *F21Y 101/02* | (2006.01) |

(52) U.S. Cl.

CPC . *F21L 4/04* (2013.01); *F21L 4/005* (2013.01); *F21L 4/027* (2013.01); *F21L 4/045* (2013.01); *F21L 15/02* (2013.01); *F21V 14/065* (2013.01); *F21V 15/01* (2013.01); *F21V 17/02* (2013.01); *F21Y 2101/02* (2013.01)

(58) Field of Classification Search

CPC ..... F21L 4/04; F21L 4/045; F21L 4/005; F21L 4/027; F21L 15/02; F21V 4/045; F21V 4/065; F21V 17/02; F21V 15/01; F21Y 2101/02

See application file for complete search history.

(56) References Cited

U.S. PATENT DOCUMENTS

| | | | | |
|---|---|---|---|---|
| 4,286,311 | A | 8/1981 | Maglica | |
| 4,307,439 | A | 12/1981 | Sassmannshausen | |
| 4,398,238 | A * | 8/1983 | Nelson | 362/187 |
| 4,951,183 | A * | 8/1990 | Wang | 362/187 |
| 5,138,537 | A * | 8/1992 | Wang | 362/187 |
| 5,806,964 | A * | 9/1998 | Maglica | 362/203 |

* cited by examiner

*Primary Examiner* — Bao Q Truong
(74) *Attorney, Agent, or Firm* — Andrew Wilford

(57) ABSTRACT

The present invention relates to a flashlight having a casing, a light source and a lamp head with a lens attachment that can be displaced longitudinally axially relative to the light source in order to focus the emitted cone of light. The object of the present invention is to provide a flashlight that, on the one hand, enables the reflector to be displaced smoothly relative to the light source and, on the other hand, prevents involuntary shifting of the focusing that has been set. According to the invention, the flashlight has a clamping device for fixing the lamp head in a selectable longitudinal axial position.

9 Claims, 8 Drawing Sheets

FLASHLIGHT THAT CAN BE FOCUSED

CROSS REFERENCE TO RELATED APPLICATIONS

This application is the US-national stage of PCT application PCT/DE2011/001148 filed 25 May 2011 and claiming the priority of PCT patent application PCT/DE2011/001148 itself filed 25 May 2011 and German patent application 202011109155.8 itself filed 15 Dec. 2011.

FIELD OF THE INVENTION

The present invention relates to a flashlight with a casing, a light source, and a lamp head having a lens attachment that can be displaced longitudinally axially relative to the light source in order to focus the emitted cone of light.

BACKGROUND OF THE INVENTION

Flashlights of this type are already known from the prior art. A lamp is described, for example, in DE 29 50 850 [U.S. Pat. No. 4,307,439] that emits an essentially parallel light beam when the filament is at the focal point of the paraboloid of the reflector. The beam can be altered by displacing the bulb and the battery casing axially relative to the lamp head and the reflector. Such an axial displacement can be effected by moving the cylinder sleeve axially relative to the battery casing. This axial movement can be effected either by a simple axial sliding movement or by a turning movement, together with a screwthread or with an inclined-slot guide system, wherein an inclined slot is, for example, provided in the lamp head, and a pin that is arranged on the battery casing engages in the slot.

However, it is a disadvantage of such a flashlight that it is intended for the adjustment of the relative position between the lamp head and the light source to be as smooth as possible, but this has the consequence that the relative position between the lamp head or the reflector and the light source can be displaced involuntarily when the flashlight is just shaken slightly, shifting the focusing that has been set. This problem is a commonly observed one in the case of bicycle lamps in particular, which are subject to permanent shaking when in use.

OBJECT OF THE INVENTION

The object of the present invention is therefore to provide a flashlight that, on the one hand, enables the reflector to be displaced smoothly relative to the light source and, on the other hand, prevents involuntary shifting of the focusing that has been set.

SUMMARY OF THE INVENTION

This object is achieved by a flashlight that has a clamping device for fixing the lamp head in a selectable longitudinal axial position. Advantageously, the possibility is thereby created of combining a smooth and precise adjustable focusing mechanism with the possibility of fixing the lamp head so that the set focus position cannot be shifted.

Preferred embodiments of the present invention are described below and in the subclaims. The present invention essentially comprises four embodiments but is not restricted thereto.

First Embodiment

According to a first preferred embodiment, the lamp head is fixed by a frictional or positive connection, wherein the clamping device can preferably be operated via a turning movement of the lamp head relative to the casing. The focus position can thus be set simply and precisely by longitudinally displacing the lamp head axially, it being possible to fix the position via a turning movement of the lamp head, it being possible to fix the position via a turning movement of the lamp head. Both settings can be made using one hand, which further increases the operability if the flashlight. As alternatives, constructions are also conceivable in which the longitudinal axial displacement of the reflector relative to the light source is effected by a turning movement and the fixing by a longitudinal axial displacement of the lamp head. The use of an expansion cone is, for example, suitable for this purpose.

According to a further preferred embodiment of the present invention, the clamping device has a clamping body that can be turned about the longitudinal axis of the flashlight, having at least one radially oriented and pivotable or expandable clamping element arranged at the end. When the clamping body is turned, the clamping element preferably slides on an upward-sloping surface that is arranged such that the clamping element is pivoted or expanded more and more radially as the clamping body is turned more and more. For this purpose, the upward-sloping surface can, on the one hand, be arranged parallel to the perimeter of the flashlight and the clamping element can be designed so that it tapers, or the upward-sloping surface is oriented at an angle to the perimeter of the flashlight and the clamping element has a constant thickness. Combinations thereof are of course covered as long as it is ensured that the clamping elements are pivoted or expanded sufficiently radially as the clamping body is turned more and more so that they fulfill their clamping function.

In the assembled state of the flashlight, the lamp head engages around the clamping device so that an annular gap is formed between the clamping device and the lamp head. As long as the clamping element is not pivoted or expanded radially, the lamp head can move longitudinally axially so that the desired focus position can be set. However, the camping element is preferably pivoted radially via a turning movement of the lamp head in such a way that it presses against the inner shell surface of the lamp head so that the lamp head is fixed with a frictional connection.

In order to be able to turn the clamping body and thus the clamping elements, according to a preferred embodiment of the present invention it is provided that the clamping body has a catch that engages in a groove of the lamp head so that the clamping body can be turned by turning the lamp head.

So that the clamping device maintains the set position even when the flashlight is shaken strongly, in the clamped state the clamping device can preferably be transferred into a locking position, for which purpose the clamping body, in particular the clamping element, and/or the bearing surface have a groove and/or a corresponding locking catch. In other words, at a certain swept angle of rotation the clamping device engages in a locked position so that the lamp head is not involuntarily turned back into the unfixed position.

The present invention is not restricted to clamping bodies that have a single clamping element and rather clamping bodies are also provided that have multiple, preferably two clamping elements. The clamping bodies and in particular the clamping elements are designed as plastic injection-molded parts.

Second Embodiment

In the second embodiment, the clamping device is preferably a cylindrical connecting piece that is connected positively to the lamp head and is arranged on the flashlight casing so that it can be moved by being pushed. In other words, the connecting piece surrounds the flashlight casing so that the flashlight head can be displaced longitudinally axially with respect to the flashlight casing. The connection between the connecting piece and the flashlight head is preferably formed by a positive connection in the form of a raised portion, on the connecting piece that has a downward-sloping surface at the rear that bears against an upward-sloping surface on the lamp head. By virtue of this special design, on the one hand a catch is formed for the longitudinal axial movement, and on the other hand a clamping device is created, because the connecting piece has a radial downward-sloping ramp that bears against an upward-sloping ramp on the lamp head and is arranged such that a longitudinal axial displacement of the lamp head relative to the connecting piece results from a relative rotational movement relative to the lamp head. During this movement, the downward-sloping surface of the connecting piece namely runs down on the upward-sloping surface of the lamp head and is pressed against the flashlight casing via its bearing surface to form a frictional connection. In order to prevent the lamp head from turning too when the connecting piece is turned, the lamp head preferably has guide elements inhibit a rotational movement between the lamp head and the flashlight casing.

This embodiment of a clamping device is particularly well suited for flashlights because the necessary parts can be manufactured simply and cost-effectively, can be assembled easily, and at the same time enable the lamp head to be fixed securely.

Third Embodiment

According to a third embodiment, the clamping device is preferably designed as a cylindrical connecting piece that is connected to the lamp head via a threaded connection. The connecting piece preferably has longitudinally axially projecting clamping elements on the front side of which inclined downward-sloping surfaces are in each case formed that bear against an upward-sloping surface on the lamp head. In order to set the desired clamping effect, the connecting piece is screwed into the lamp head so that the downward-sloping surface slides on the is upward-sloping surface as a result of a longitudinal axial relative movement between the connecting piece and the lamp head and the clamping elements form a frictional connection with respect to the flashlight casing. To ensure that the lamp head is not turned too when the connecting piece is turned, guide elements are provided on the flashlight casing that prevent the flashlight head from turning at the same time.

Fourth Embodiment

Lastly, according to a further embodiment the clamping device is formed by multiple clamping elements that engage in grooves of a locking element. The locking element preferably takes the form of a pin and is part of a connecting piece that is connected to the casing. According to a preferred embodiment of the invention, the clamping elements have a recess through which the locking element engages, wherein part surfaces of the clamping elements are held in the grooves of the locking element and thus in an engaged position by the force of a spring. The springs are preferably integrally connected to the clamping elements and are designed as leaf springs that are supported against a prolog on the outside of the flashlight head. The clamping elements can be moved into a disengaged position in the lamp head counter to the force of the springs so that the lamp head can be displaced longitudinally axially. At least four clamping elements are preferably provided here so that at least two clamping elements engage under the force of the springs whatever the longitudinal axial position of the lamp head. The clamping device described consequently provides the possibility of stepless adjustment that is easy to effect in order to focus the flashlight.

BRIEF DESCRIPTION OF THE DRAWING

Other preferred embodiments of the present invention are explained below with reference to the drawings, in which.

SPECIFIC DESCRIPTION OF FIRST CONCRETE EMBODIMENT

Figure 1:
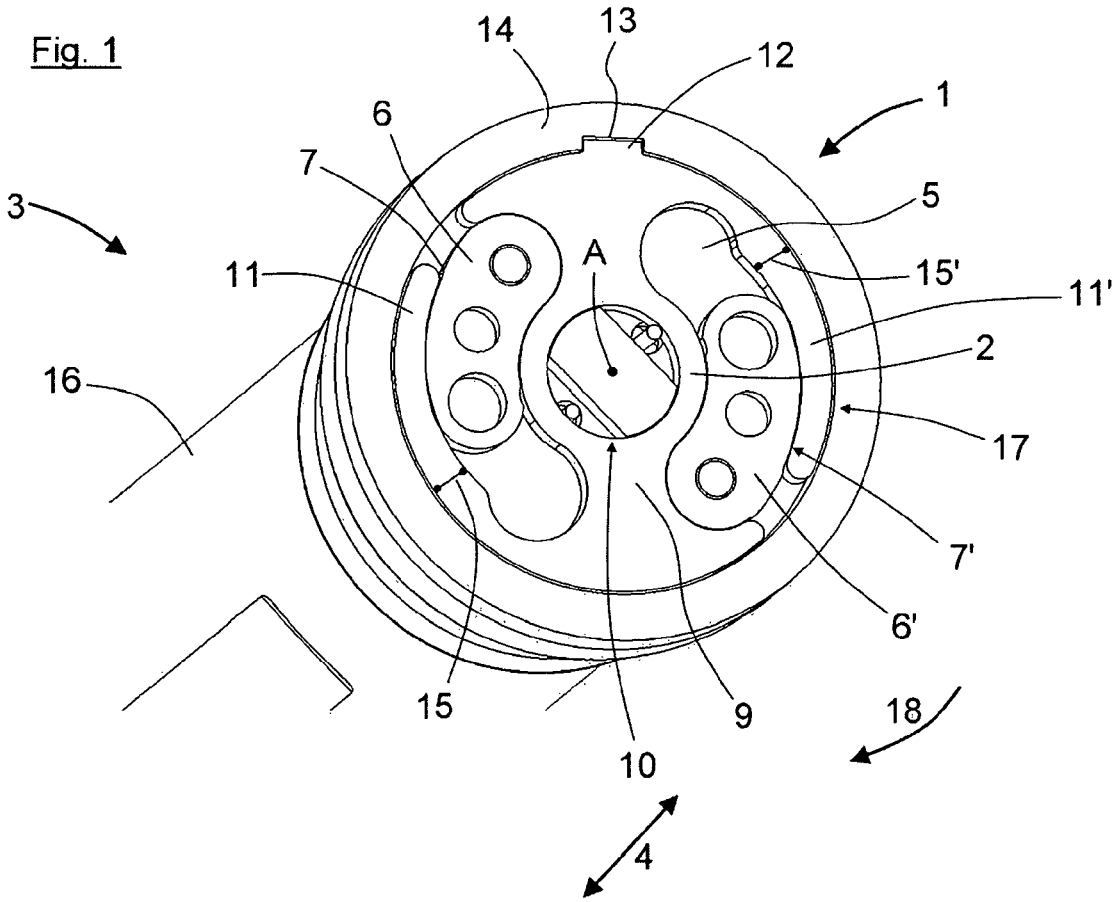
FIG. 1 shows a schematic view from above of a clamping device.

According to a concrete embodiment of the present invention, the clamping device 1 has a clamping body 2 that is mounted so that it can rotate about the longitudinal axis A of the flashlight 3. The clamping body 1 here bears against a base plate 5 at the center of which a light source, preferably an LED 21, is arranged. Moreover, two kidney-shaped elements 6, 6' that fulfill two functions are arranged on the base plate 5. On the one hand, the outer surfaces of the kidney-shaped elements 6, 6' are designed as upward-sloping surfaces 7, 7'. On the other hand, the kidney-shaped elements 6, 6' serve as spacers for a cover plate 8 (see FIG. 2) that covers the clamping device 1 from the lens attachment 20.

The clamping body 2 essentially consists of a web 9 arranged along the diameter of the flashlight 3, a central recess 10 being provided for the passage of the LED 21. Two clamping elements 11, 11' that bear against the upward-sloping surfaces 7, 7' are pivotably arranged radially on the web 9. Furthermore, the clamping body 9 has a radially projecting catch 12 that engages in a groove 13 of the lamp head 14 in the assembled state. In the embodiment shown, an annular gap 17 is formed between the lamp head 14 and the casing 16 or the base plate 5 so that the lamp head 14 can be displaced longitudinally axially (arrow 4). However, if the lamp head 14 is turned clockwise (arrow 18), the clamping elements 11, 11' are pressed against the cylindrical inner shell surface of the lamp head 14 because the clamping elements 11, 11' have a thickness 15,15' that gets larger and larger, so that they are pushed outward by the kidney-shaped elements 6, 6' and close the annular gap 17 in some areas. The force with which the clamping elements 11, 11' push against the inner shell surface of the lamp head 14 is great enough to fix the latter with frictional contact. To prevent the clamping device 1 from involuntarily falling back into the unfixed position shown in FIG. 1, the locking elements 11, 11' have locking lugs 19, 19' that, together with the kidney-shaped elements 6, 6', form an engaged position. The fixed position can thus be quit only by actively turning back the lamp head 14 and therefore the clamping body 2.

Figure 2A:
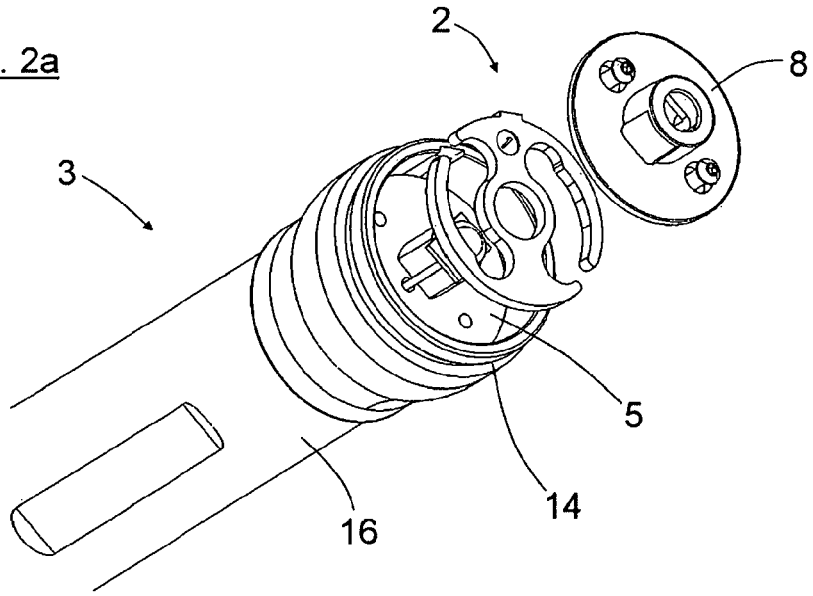
FIG. 2*a* shows an exploded view of a flashlight with a lamp head and a clamping device.
Figure 2B:
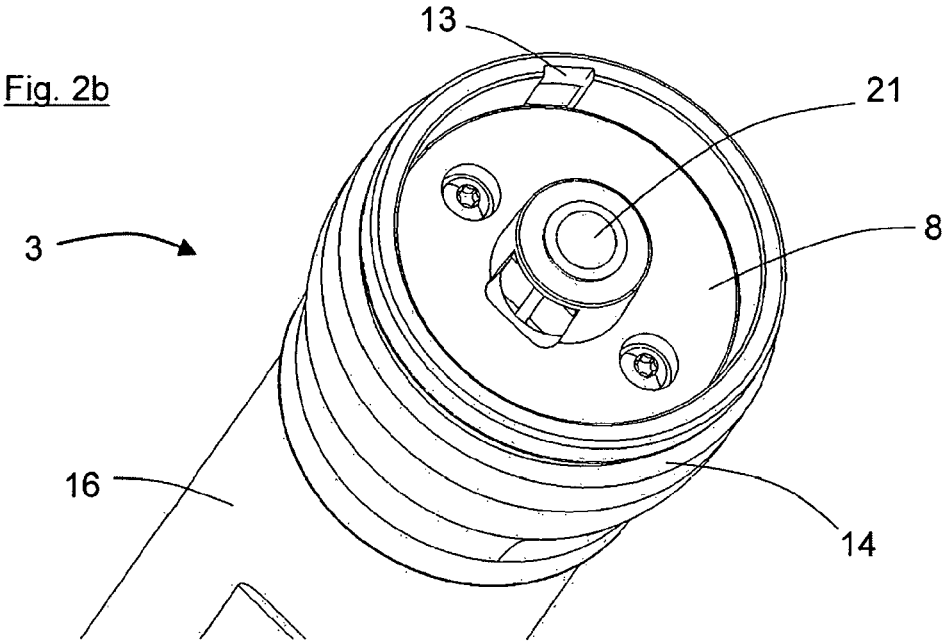
FIG. 2*b* shows a flashlight with a clamping device in the assembled state and FIG. 3 shows a view in cross section of an assembled flashlight with a clamping device.

FIG. 2*a* shows an exploded view of a flashlight 3 with the casing 16, the lamp head 14, the base plate 5, the clamping body 2 and the cover plate 8. In the assembled state (see FIG. 2*b*), the clamping device 1 and the clamping body 2 are mounted between the base plate 5 and the cover plate 8.

Figure 3:
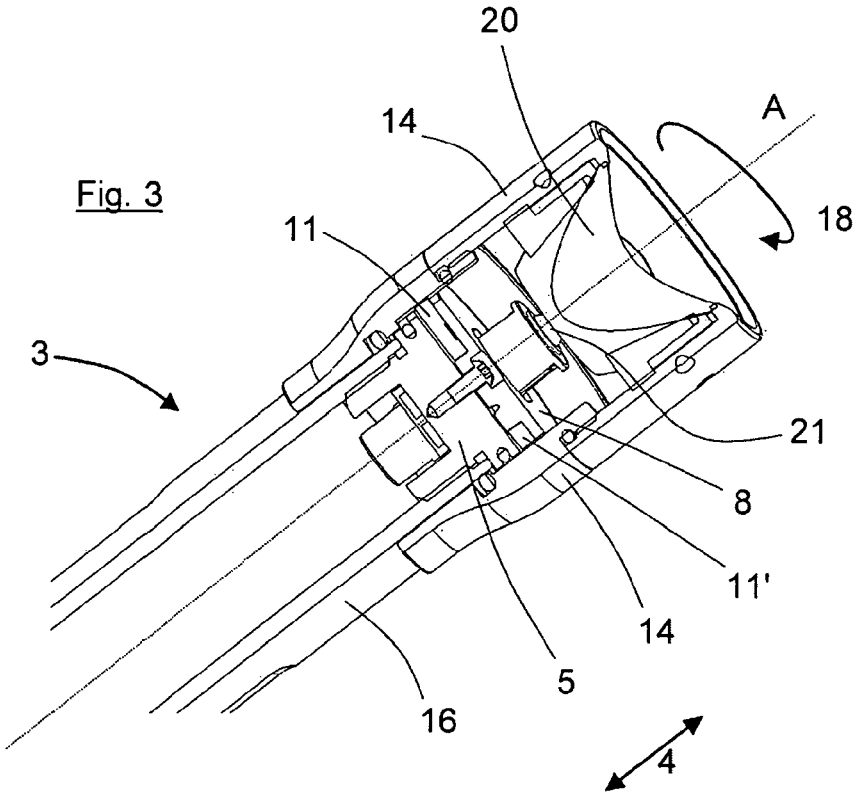

The mode of operation of the present flashlight can be seen with the aid of the cross-sectional view in FIG. 3. At its front end, the flashlight casing 16 has a base plate 5 that is connected, spaced apart, to the cover plate 8. The clamping device 1 with the clamping elements 11, 11' is arranged between the cover plate 8 and the base plate 5. The flashlight casing 16, the base plate 5, the clamping device 1, and the cover plate 8 are surrounded by the lamp head 14, at the end of which a lens attachment 20 is arranged. In the unfixed position, the lamp head 14 can be displaced longitudinally axially with respect to the LED 21, as a result of which the desired focus setting can be selected. When the lamp head 14 is turned (in the direction of the arrow 18) about the longitudinal axis A of the flashlight, the clamping elements 11, 11' are pushed against the cylindrical inner shell surface of the lamp head 14 in such a way that longitudinal axial displacement (arrow 17) is effectively prevented. In this state, it is not possible for the set focus position to be adjusted involuntarily.

SPECIFIC DESCRIPTION OF SECOND CONCRETE EMBODIMENT

Figure 4A:
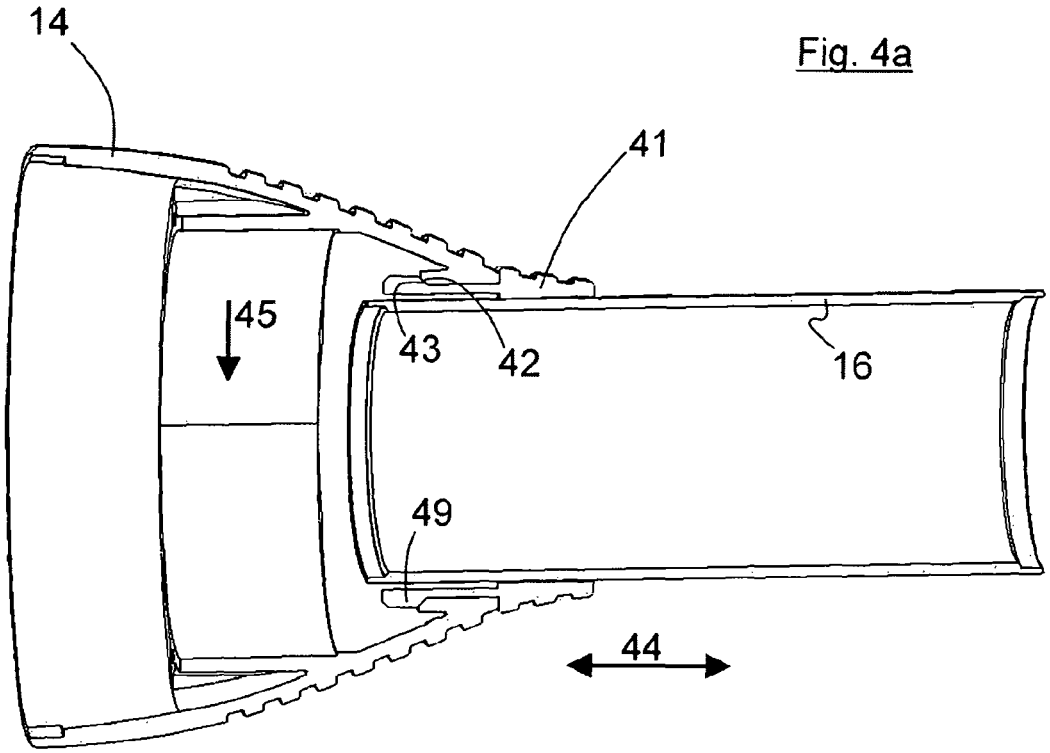
FIGS. 4*a-c* show different view of an alternative clamping device with a connecting piece, FIGS. 5*a+b* show a further embodiment of a clamping device with a connecting piece
Figure 4B:
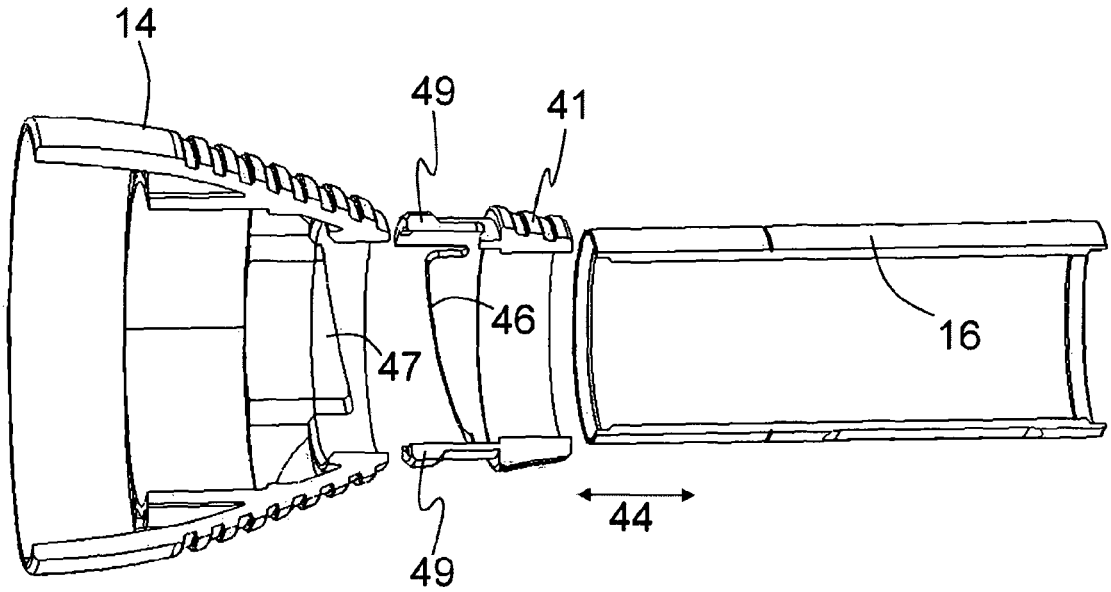
Figure 4C:
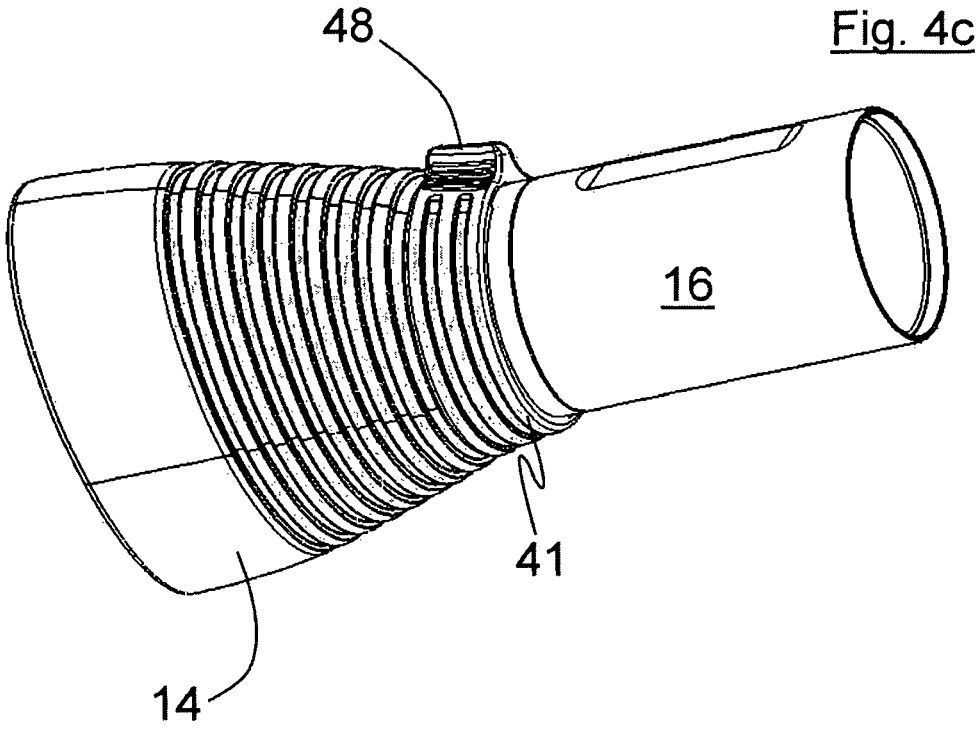

A further embodiment is shown in FIGS. 4*a* to 4*c*. The clamping device is designed as a cylindrical connecting piece 41 that is positively connected to the lamp head 14. The lamp head 14 and the connecting piece 41 thus bear against each other via their upward-sloping surfaces 42 and downward-sloping surfaces 43 respectively, the downward-sloping surface 43 being formed on the rear of a raised portion 49. Owing to a longitudinal axial displacement between the connecting piece 41 and the flashlight head 14 in the direction of the arrow 44, the downward-sloping surface 43 runs down on the upward-sloping surface 42 so that the connecting piece 41 at this point is pushed in the direction of the arrow 45 against the flashlight casing 16 until it bears frictionally against it. The lamp head 14 can consequently be fixed comfortably in a selectable longitudinal axial position.

FIG. 4*b* shows an exploded view of the flashlight, wherein the downward-sloping ramp 46 on the connecting piece and the upward-sloping ramp 47 on the flashlight head can be seen, bearing against each other in the assembled state. When there is a relative rotational movement between the connecting piece 41 and the flashlight head 14, they are displaced longitudinally axially toward each other in the direction of the arrow 44 so that the connecting piece 41 is clamped in place. Guide elements (not shown) are provided to prevent the lamp head 14 from turning too when the connecting piece 41 is turned.

FIG. 4*c* shows an embodiment of the flashlight in the assembled state. A catch 48 that can be pushed by a thumb is provided so that the connecting piece 41 can also be operated with one hand.

SPECIFIC DESCRIPTION OF THIRD CONCRETE EMBODIMENT

Figure 5A:
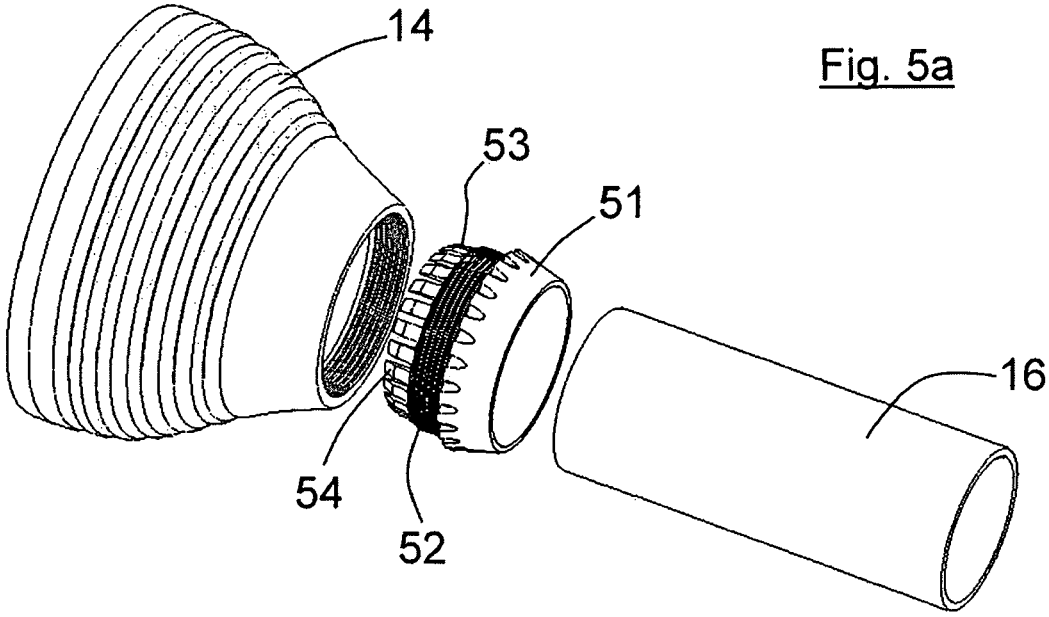
Figure 5B:
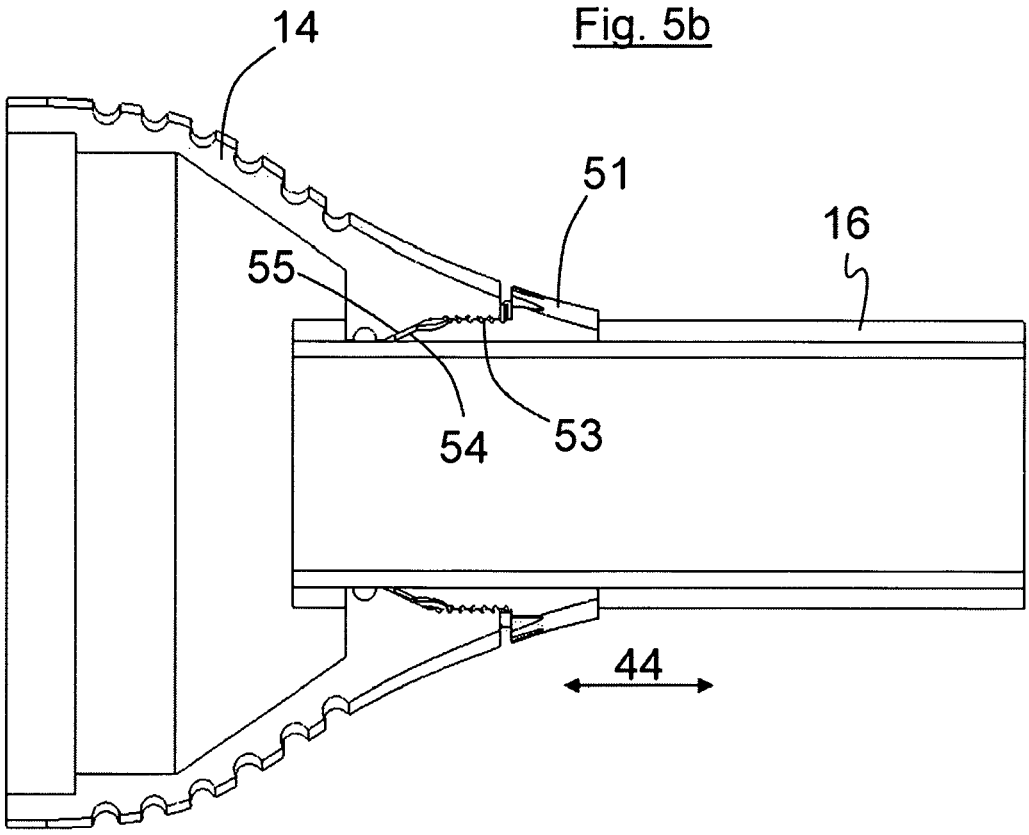

According to a further concrete embodiment, the clamping device is designed as a cylindrical connecting piece 51 that can be connected to the lamp head 14 via a threaded connection 52. The connecting piece 51 has multiple clamping elements 53 on the front side of which downward-sloping surfaces 54 are formed. It can be clearly seen in FIG. 5*b* that the connecting piece 51 can be displaced, together with the flashlight head, in the direction of the arrow 44. However, the connecting piece 51 can be screwed even further onto the flashlight head 14 by a turning motion so that the downward-sloping surface 54 runs down the upward-sloping surface 55 and the connecting piece 51 is pushed onto the flashlight casing 16 until it is frictionally connected. In this embodiment too, guide elements (not shown) are provided that prevent the lamp head 14 from turning at the same time.

SPECIFIC DESCRIPTION OF FOURTH CONCRETE EMBODIMENT

A further concrete embodiment of a clamping device for releasably fixing a lamp head 14 in a selectable relative position with respect to the flashlight casing 16 is shown in FIGS. 6*a* to 6*f*. In the embodiment shown, the clamping device is formed by four clamping elements 61 that engage in grooves 62 of a pin-shaped locking element 63. The locking element 63 is configured as part of a connecting piece 64 that is connected to the flashlight casing 16 via a threaded portion 65. The clamping elements 61 are housed in a recess of the flashlight head 14 and have a central recess 66 through which the locking element 63 engages. The clamping elements 61 have wedge-shaped surface portions 67, 67' that, in the locked-in position, bear against the walls of the grooves 62 of the locking element 63. Because four clamping elements 61 are provided in the embodiment shown, at least two of them in each case engage in the grooves 62 independently of the longitudinal axial position so that longitudinal axial displacement is inhibited.

Figure 6A:
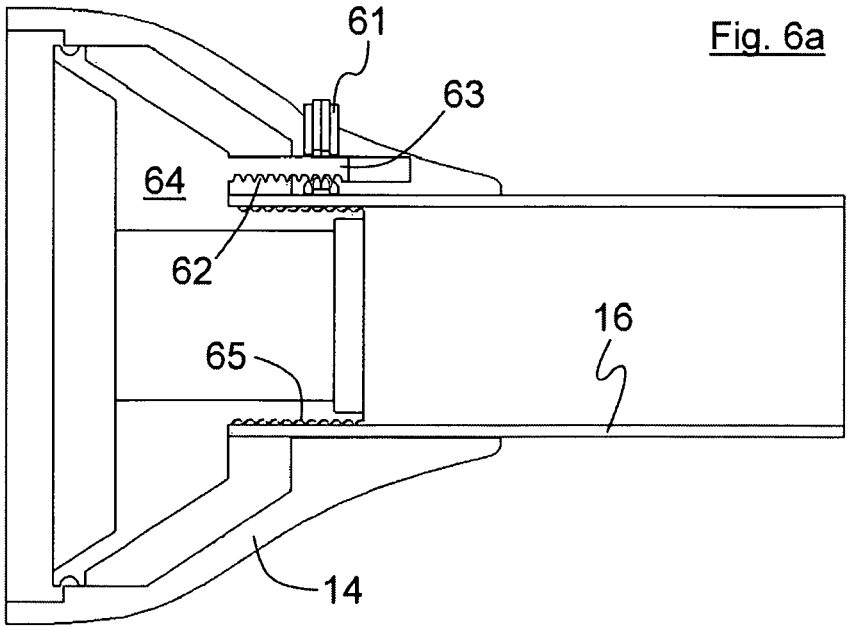
FIGS. 6*a-f* show different views of a flashlight with a clamping device with multiple clamping elements.
Figure 6B:
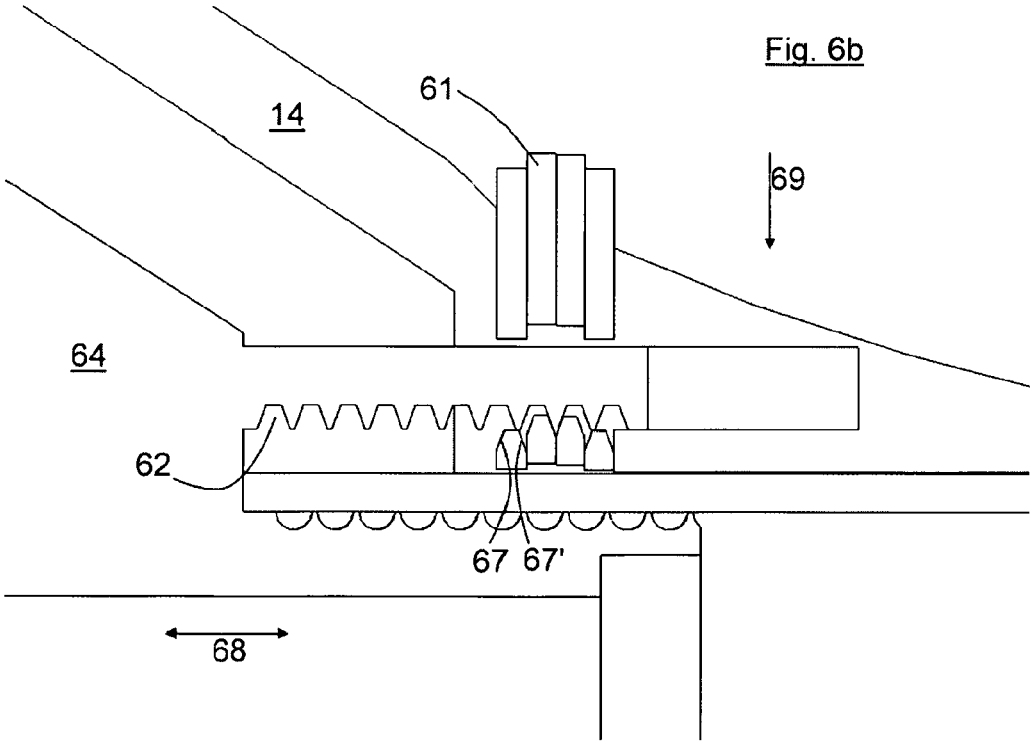
Figure 6C:
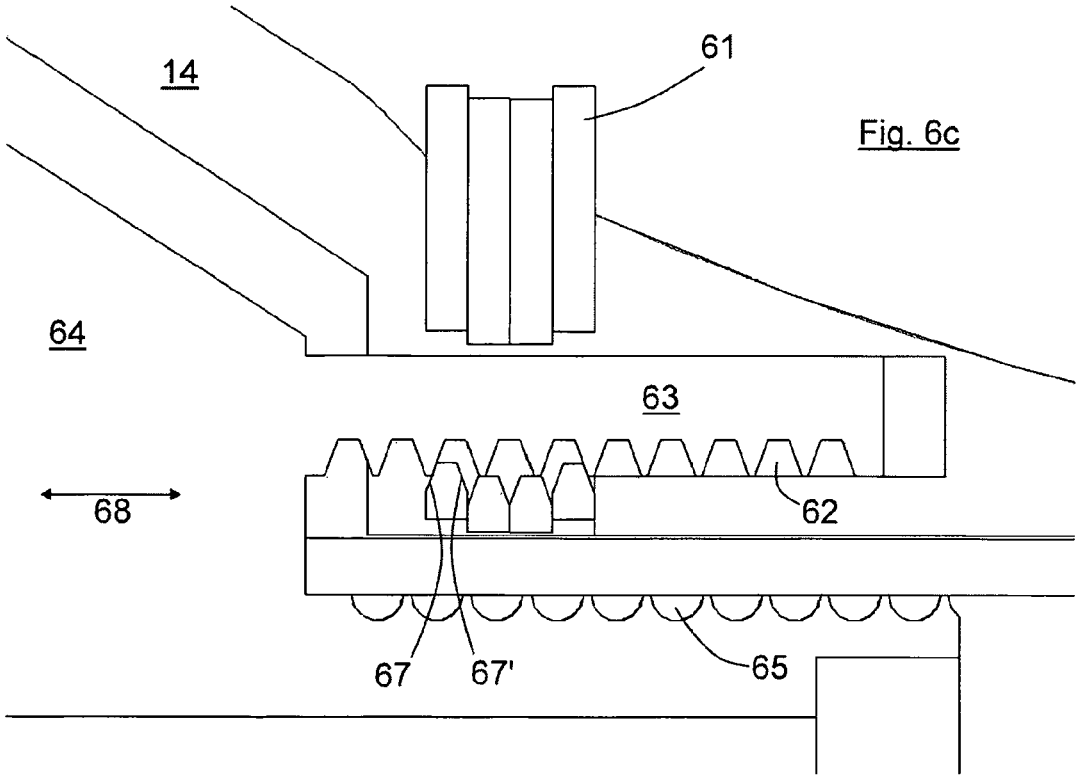
Figure 6D:
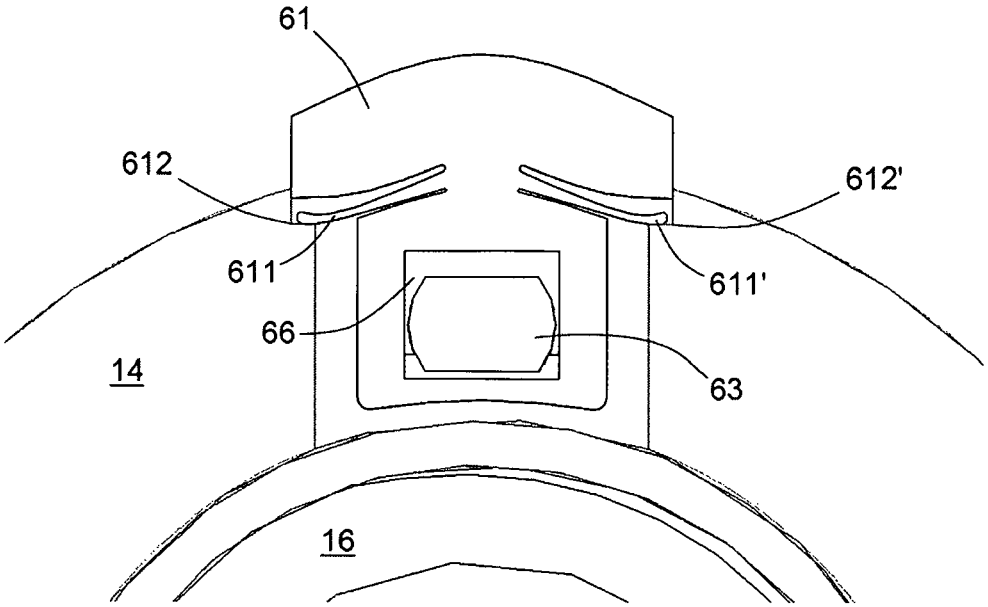

FIGS. 6*b* and 6*c* show two different relative positions of the lamp head 14 with respect to the flashlight casing 16 and to the connecting piece 64, respectively, and two different locked-in positions of the clamping elements 61. In FIG. 6*b*, the two central clamping elements 61 engage in the grooves 62, whereas in FIG. 6*c* the two outer clamping elements 61 are arranged in the locked-in position. In order to displace the lamp head 14 longitudinally axially in the direction of the arrow 68, the clamping elements 61 need to be moved out of the locked-in position by being pushed in the direction of the arrow 69 counter to the force of a spring. FIG. 6*d* shows (in a view from above) a concrete embodiment of a clamping element 61 with the central recess 66 and leaf springs 611, 611' that, in the assembled state, are supported against projections 612, 612' in the flashlight head 14.

Figure 6E:
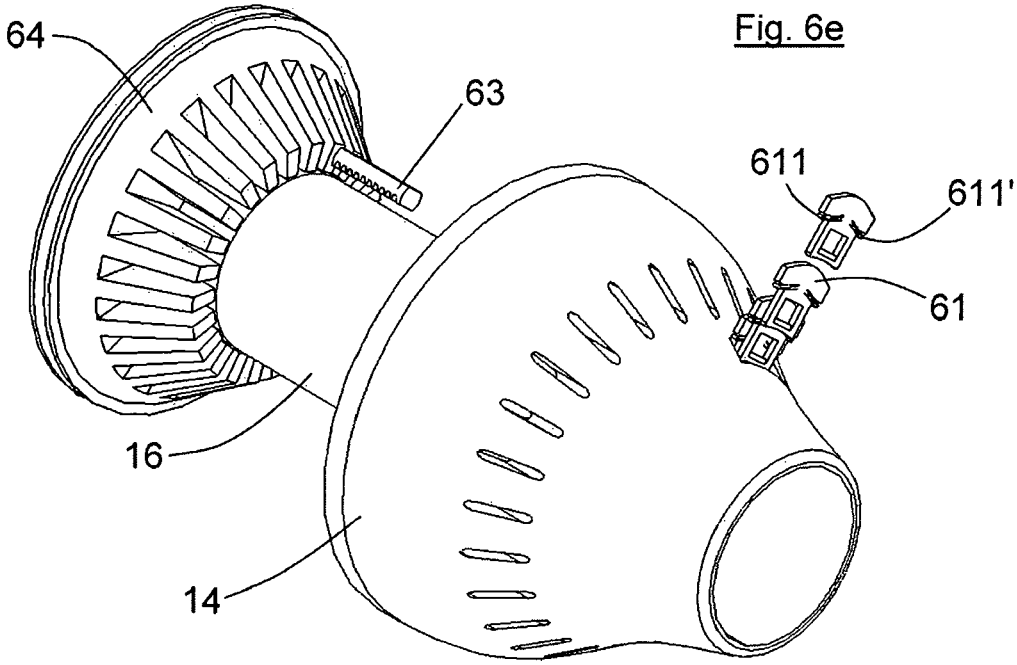
Figure 6F:
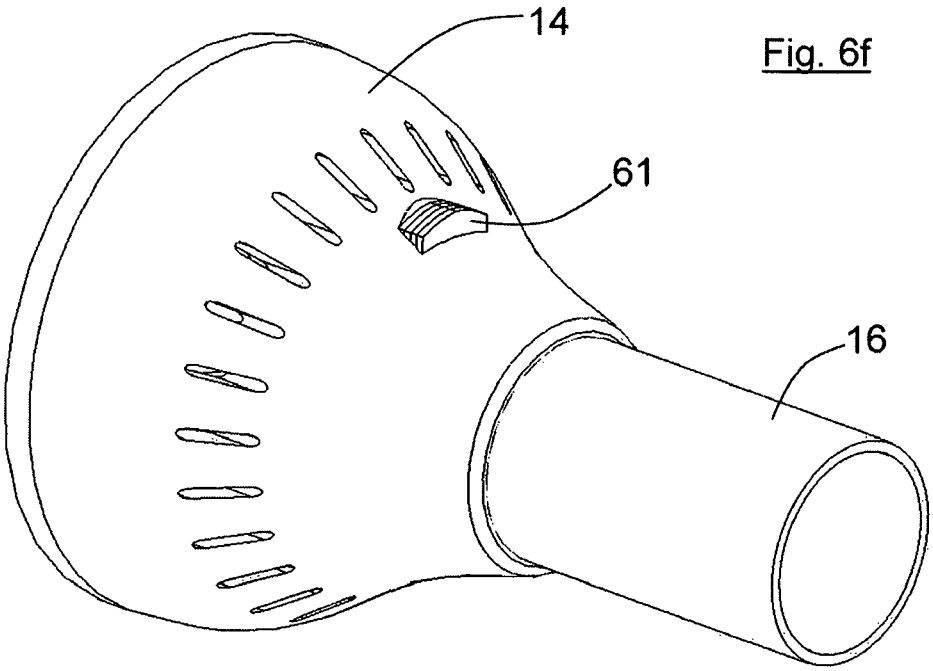

The perspective views in FIGS. 6*e* and 6*f* show the flashlight in an exploded view (FIG. 6*e*) and in the assembled state (FIG. 6*f*). FIG. 6*f* clearly shows that the locking elements 63 are positioned in such a way that are pushed down easily with a thumb so that the focusing can be performed using one hand.

The invention claimed is:

1. A flashlight having a casing extending along an axis, a light source capable of emitting a cone of light, a lamp head with a lens attachment that can be displaced longitudinally axially relative to the light source in order to focus the emitted cone of light, and a clamping body rotatable about the axis and having an end carrying a radially oriented and pivotable or expandable clamping element for fixing the lamp head in a selectable longitudinal axial position on the casing.

2. The flashlight as claimed in claim 1, wherein the lamp head is secured to the casing with a frictional or positive connection.

3. The flashlight as claimed in claim 1, wherein the clamping body can be operated by rotation of the lamp head.

4. The flashlight as claimed in claim 1, wherein, when the clamping body is turned, the clamping element slides on an upward-sloping surface that is arranged such that the clamping element is pivoted or expanded more and more radially as the clamping body is turned more and more.

5. The flashlight as claimed in claim 4, wherein the upward-sloping surface extends parallel to an outer surface of the flashlight and the clamping element is designed so that it tapers, or the upward-sloping surface is oriented at an angle to the outer surface of the flashlight and the clamping element has a constant thickness.

6. The flashlight as claimed in claim 1, wherein, when pivoted radially, the clamping element pushes against an inner shell surface of the lamp head in such a way that the lamp head is mounted with a frictional connection.

7. The flashlight as claimed in claim 1, wherein the clamping body has a catch that engages in a groove of the lamp head so that the clamping body can be turned by turning the lamp head.

8. The flashlight as claimed in claim 5, wherein in the clamped state the clamping element can shift into a locking position, for which purpose the clamping element, or the upward-sloping surface has a groove or a corresponding locking lug.

9. The flashlight as claimed in claim 1, wherein the clamping body has a plurality of the clamping elements and is a plastic injection-molded part.

* * * * *